US007073798B1

(12) United States Patent
Bonaventure et al.

(10) Patent No.: US 7,073,798 B1
(45) Date of Patent: Jul. 11, 2006

(54) ROLLER SKATE

(75) Inventors: Laurent Bonaventure, Cran-Gevrier (FR); Jean-Louis Demarchi, Saint-Jorioz (FR)

(73) Assignee: Salomon S.A., Metz-Tessy (FR)

( * ) Notice: Subject to any disclaimer, the term of this patent is extended or adjusted under 35 U.S.C. 154(b) by 1047 days.

(21) Appl. No.: 09/662,636

(22) Filed: Sep. 15, 2000

Related U.S. Application Data

(63) Continuation of application No. 08/759,416, filed on Dec. 5, 1996, now Pat. No. 6,196,556.

(30) Foreign Application Priority Data

Dec. 8, 1995 (FR) ..... 95 15016

(51) Int. Cl.
*A63C 17/04* (2006.01)

(52) U.S. Cl. ..... 280/11.202; 280/11.221

(58) Field of Classification Search ..... 280/11.19, 280/11.202, 11.221, 11.27
See application file for complete search history.

(56) References Cited

U.S. PATENT DOCUMENTS

| | | | | |
|---|---|---|---|---|
| 2,751,692 | A | 6/1956 | Cortina | 36/3 |
| 3,012,342 | A | 12/1961 | Ramirez | 36/3 B |
| 3,624,930 | A | 12/1971 | Johnson et al. | 36/3 B X |
| 4,507,880 | A | 4/1985 | Ohashi | 36/115 |
| 4,602,441 | A | 7/1986 | El Sakkaf | 36/3 R |
| 4,679,335 | A | 7/1987 | Berlese | 36/131 |
| 4,860,463 | A | 8/1989 | Pin | 36/3 B |
| 4,939,851 | A | 7/1990 | Miller | 36/3 B |
| 5,171,033 | A | 12/1992 | Olson et al. | 280/11.22 |
| 5,342,070 | A | 8/1994 | Miller et al. | 280/11.22 |
| 5,365,677 | A | 11/1994 | Dalhgren | 36/3 A |
| 5,390,941 | A | 2/1995 | Pozzobon et al. | 280/11.22 X |
| 5,400,526 | A | 3/1995 | Sessa | 36/3 B |
| 5,401,039 | A | 3/1995 | Wolf | 280/11.22 |
| 5,437,466 | A | 8/1995 | Meibock et al. | 280/11.22 |
| 5,515,622 | A | 5/1996 | Lee | 36/3 R |
| 5,797,610 | A | 8/1998 | Grande et al. | 280/11.22 |

FOREIGN PATENT DOCUMENTS

| | | |
|---|---|---|
| DE | 177905 | 4/1905 |
| DE | 9406345 | 7/1994 |
| GB | 2019194 | 10/1979 |
| PL | 53447 | 5/1967 |
| WO | WO86/03951 | 7/1986 |
| WO | WO95/13716 | 5/1995 |
| WO | WO95/29605 | 11/1995 |
| WO | WO98/35572 | 8/1998 |

*Primary Examiner*—Lesley D. Morris
(74) *Attorney, Agent, or Firm*—Greenblum & Bernstein, P.L.C.

(57) ABSTRACT

An in-line roller skate including a chassis of which one longitudinal lower portion carries the wheels, on the one hand, and a boot formed by a shell overlying a sole adapted to be fixed on an upper plate of the chassis, on the other hand, the volume of the upper being in communication with the outside so as to obtain the internal ventilation thereof by an air supply, wherein it includes air passages interposed between an external collecting zone and the internal volume of the shell, these air passages being constituted by a ventilation chamber provided beneath an internal plantar support of the boot and communicating with the internal volume of the shell.

24 Claims, 3 Drawing Sheets

ROLLER SKATE

CROSS-REFERENCE TO RELATED APPLICATIONS

This is a continuation of application Ser. No. 08/759,416, filed on Dec. 5, 1996 now U.S. Pat. No. 6,196,556, the disclosure of which is hereby incorporated by reference thereto in its entirety and the priority of which is claimed under 35 USC 120.

This application is also based upon French application No. 95.15016, filed on Dec. 8, 1995, the disclosure of which is hereby incorporated by reference thereto in its entirety and priority of which is claimed under 35 USC 119.

BACKGROUND OF THE INVENTION

1. Field of the Invention

The present invention relates to a roller skate, and particularly an in-line roller skate, including a chassis of which one longitudinal lower portion carries the wheels, on the one hand, and a boot formed by an upper overlying a sole adapted to be fixed on an upper plate of the chassis, on the other hand, the internal volume of the upper and/or the sole being in communication with the ambient air at the exterior of the boot, so as to obtain the internal ventilation of the boot, as the skate moves forwardly.

2. Description of Background and Relevant Information

The aforementioned type of skate is adapted to the training of ice skaters outside of a skating rink, but also for any athletes eager to maintain or perfect, on asphalt or concrete surfaces, etc., the techniques used in gliding sports such as trail skiing, cross country skiing, ice skating, etc.

Thus, the practice of this sport includes a driving or propelling phase that occurs by causing the skate to diverge outwardly and by taking a lateral support on the wheels that are thus inclined, in a manner similar to edge setting, then a gliding phase that occurs by repositioning the wheels perpendicularly with respect to the ground.

A boot of this type is known from U.S. Pat. No. 5,171,033. This patent describes a boot that has the particularity of being made from a rigid shell including a plurality of ventilation openings leading into the internal volume of the shell. A liner is freely arranged in this shell so that the movements of the foot cause an internal ventilation by means of a cooperation between the pumping action provided by the movement of the liner within the shell and the openings of the shell.

If such a concept is capable of promoting the aeration of the foot, it however maintains all of the rigidity of the boot, because although the shell receives a flexible liner, it constitutes a firm foot-enveloping structure.

Furthermore, the effectiveness of the pumping action exerted by the liner is quite uncertain due to the fact that in a boot of this type, one precisely seeks to avoid any relative foot movement that generates discomfort (friction, blisters) and lack of precision.

One also seeks in such a product a flexible and light boot structure which ensures a good foot retention, a comfort of use, and less fatigue.

U.S. Pat. No. 5,401,039 discloses ventilating the internal volume of the shell by supplying ambient air, captured from outside the boot, by holes provided in the lower plane of the sole, via a conduit at the end of which an air inlet is provided, and inside which a turbine affixed to one of the wheels of the skate is positioned to ensure the rotational drive thereof.

This is a complicated design due to the fact that it requires the use of moving elements. In addition, the air is freely introduced in the shell, which provides a diffuse aeration that does take into account that a moving foot has specific perspiration points toward which the ventilation air must preferably be directed.

SUMMARY OF THE INVENTION

An object of the present invention is to remedy the aforementioned drawbacks and to achieve the desired results mentioned hereinabove. Therefore, an object of the present invention is to provide an improved in-line roller skate that especially allows for a good foot ventilation and conciliates foot retention, comfort, and lightness.

To this end, the invention relates to an in-line roller skate including a chassis of which one longitudinal lower portion carries the wheels, on the one hand, and a boot formed by an upper overlying a sole adapted to be fixed on an upper plate of the chassis, on the other hand, the volume of the upper and/or sole being in communication with the outside so as to obtain the internal ventilation thereof by the ambient air, wherein it includes an air passage arrangement interposed between an external air collection zone and the internal volume of the shell, these air passages having a non-deformable volume.

Advantageously, these air passages are constituted by a ventilation chamber having a non-deformable volume provided beneath a plantar support of the boot and communicating with the internal volume of the upper.

BRIEF DESCRIPTION OF THE DRAWINGS

The present invention is also related to the characteristics which will become apparent from the following description, and which must be considered separately or according to all of their possible technical combinations.

This description, provided by way of non-limiting examples, will help to better understand how the invention can be embodied, with reference to the annexed drawing, in which.

DETAILED DESCRIPTION OF THE INVENTION

Figure 1:
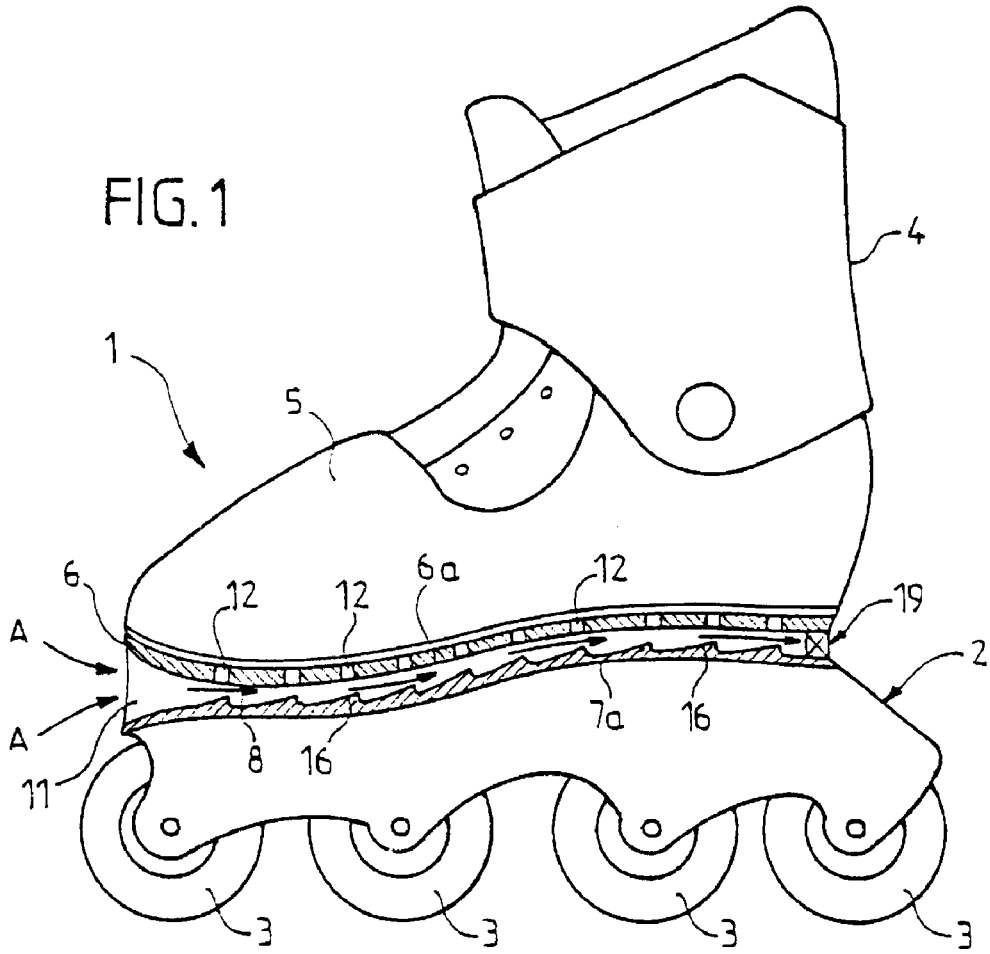
FIG. 1 is a side elevation view of an in-line roller skate and of an associated boot ventilated according to the invention.

The in-line roller skate generally designated by reference numeral 1 and shown in FIG. 1 includes a frame/chassis 2 of which one longitudinal lower portion carries the wheels 3, on the one hand, and a shoe/boot 4 formed by an upper in the form of a rigid shell 5 overlying a sole 6 adapted to be fixed on an upper plate 7 of the chassis 2, on the other hand, the internal volume of the shell 5 being in communication with the outside, so as to obtain the internal ventilation of the volume by means of the air supply A, via an air passage arrangement 8.

Generally, the passages for air A, interposed between an external collection zone and the internal volume of the shell 5, are constituted by a ventilation chamber 8 provided beneath the external sole 6 defining a plantar support 9 of the boot 4, and in communication with the internal volume of the shell 5.

According to the example shown in FIGS. 1–4, the ventilation chamber 8 is demarcated by the lower external plane or surface 6*a* of the sole 6 of the boot 4 and by the upper plane or surface 7*a* of the plate 7 of the chassis 2, which cooperates during closure with the plane 6*a* via a peripheral connecting portion 10 in which at least one zone 11 for collecting air A is provided. This ventilation chamber 8, provided between two rigid portions 6, 7 therefore has a non-deformable volume.

The collecting zone 11 here is a front inlet formed by an interruption of the peripheral edge 10 between the front of the plate 7 of the chassis 2 and the sole 6 of the tip of the boot 4. This air inlet could be lateral, or could even be combined with a plurality of front and/or lateral inlets. The advantage is that this air inlet is positioned on a surface of the skate arranged perpendicularly to the direction of displacement, such that the draft generated by the displacement of the skate rushes directly into the ventilation chamber, the air inlet being located at an exterior of the boot in free-flow communication with the ventilation chamber.

As shown in FIG. 1, the air inlet opening 11 is configured for producing an increase in the velocity of air entering the inlet opening and being directed to the ventilation chamber 8. As an example, it is seen that the inlet opening is forwardly flared. A forwardmost cross section of the air inlet opening has a greater area than that of a rearward cross section.

Figure 2:
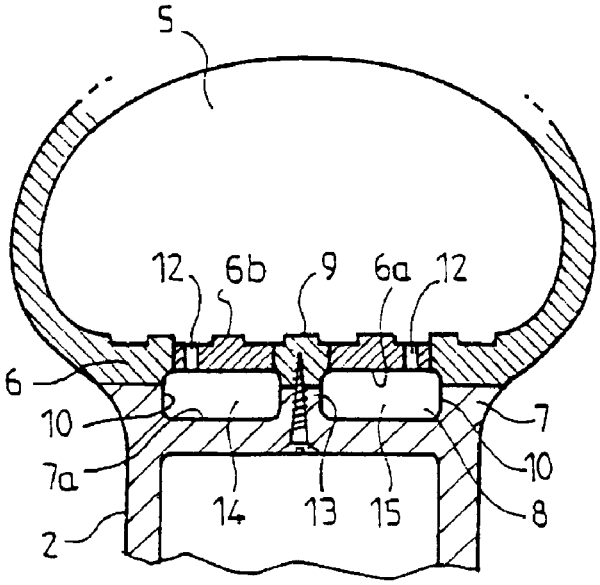
FIG. 2 is a transverse cross-sectional view of the skate according to FIG.
Figure 3:
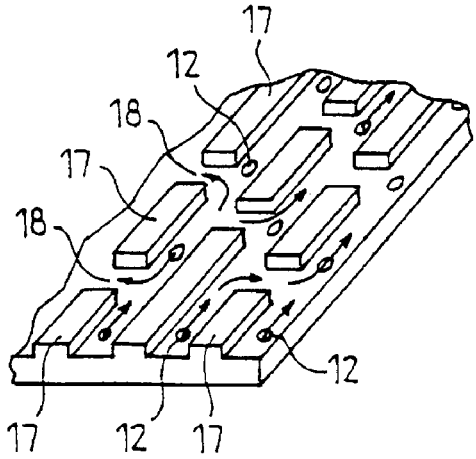
FIG. 3 is an internal detailed view showing the plantar support of the sole.
Figure 4:
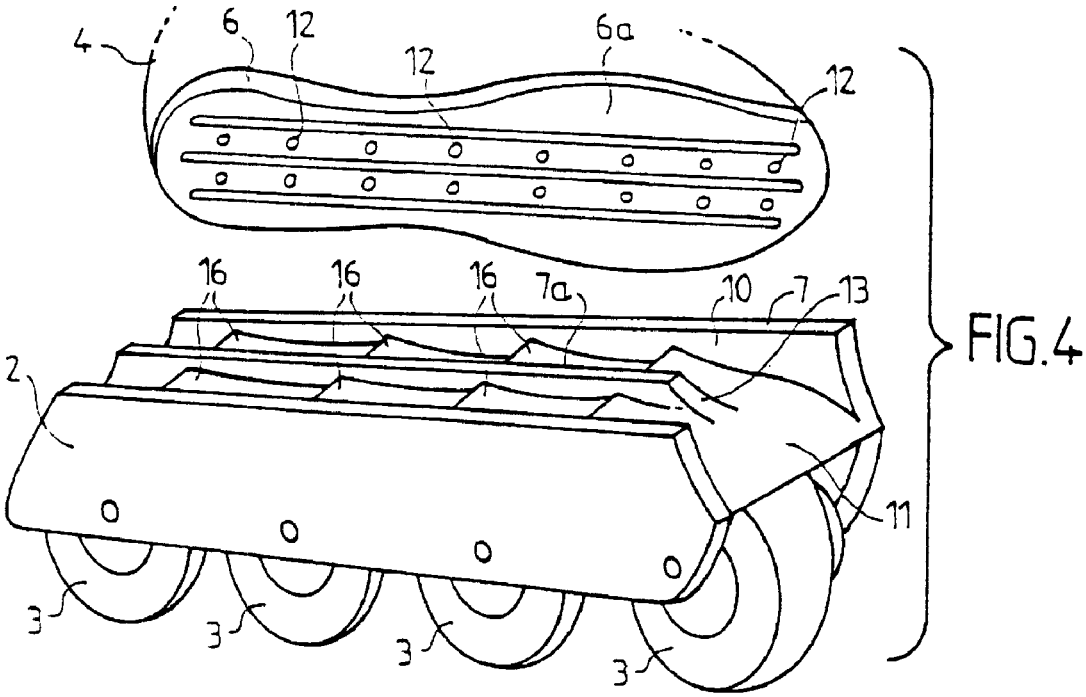
FIG. 4 is a perspective view of a skate according to FIG. 1 whose boot is detached from the chassis to show the ventilation arrangement of the boot.

The communication of the ventilation chamber 8 with the internal volume of the shell 5 is had through holes 12 obtained according to an arrangement selected in the plantar support 9 and, in this example, in the external sole 6. As also shown in FIGS. 2 and 3, the ventilation chamber 8 can be divided by at least one longitudinal rib 13, so as to constitute two air passage nozzles 14, 15 for the collected air A, across from which a plurality of aeration holes 12 are provided.

It is also contemplated to provide a larger number of nozzles. A single nozzle is also contemplated.

According to another characteristic of the invention, shown in FIG. 1, the bottom 7*a* of each of the nozzles 14, 15 for the passage of air A includes, opposite each of the aeration holes 12, deflectors 16 adapted to create jumps and swirls of air A in order to increase its flow rate and to promote its forced introduction into the holes 12.

Furthermore, the internal plane 6*b* of the sole forming the plantar support 9 includes a plurality of longitudinal ribs 17 interrupted by connecting passages 18 therebetween so as to constitute baffle passages, thereby promoting the circulation and distribution of air A beneath the user's foot.

This first embodiment of the invention, with the collection of air at the front, has the advantage of providing a much better imperviousness with respect to a construction with holes provided directly beneath the sole or directly on the shell. Moreover, the introduction of air is much better since the air inlet extends directly perpendicularly to the flow of the moving draft. It must be specified that the rear end of the ventilation chamber 8 can include a plug 19 or a closure valve with adjustable output for adjusting the air flow rate. Such a valve can also be provided at the front, in the area of the air inlet.

Alternative embodiments based on the principle that has just been described are shown in FIGS. 5–9. It is readily apparent that the alternative embodiments can embody the attributes of the embodiment of FIGS. 1–4, just described, that are not inconsistent with the principle that has just been described in connection with FIGS. 1–4. The principle includes, for example, the provision of the aforementioned deflectors 16, the baffle passages 18, and the plug or closure valve 19 for modifying the air flow rate of the ventilating air that exits the boot.

Figure 5:
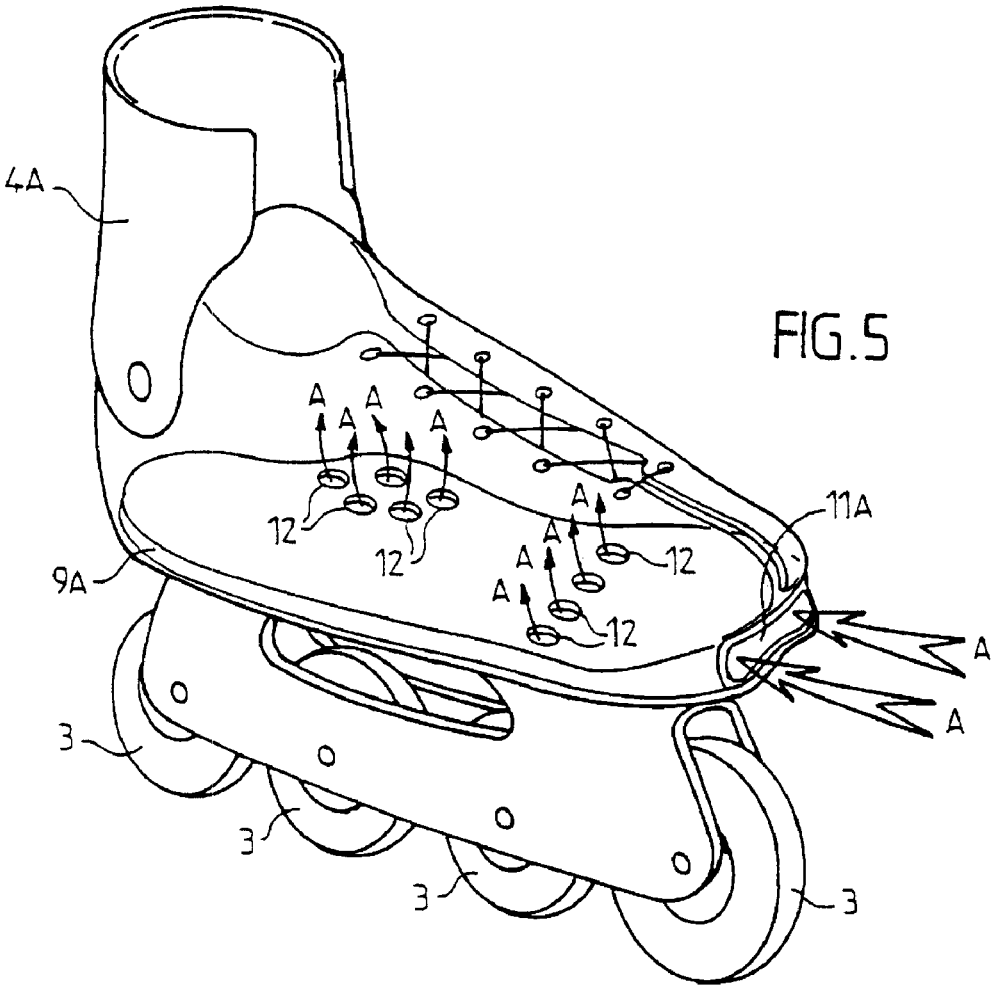
FIG. 5 is a perspective view of a skate according to an alternative embodiment of the ventilation arrangement.
Figure 6:
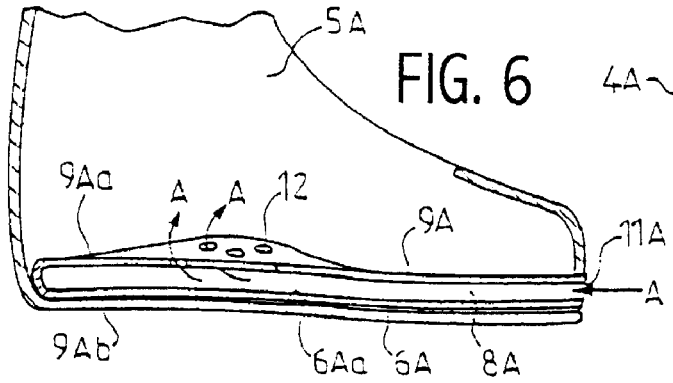
FIG. 6 is a longitudinal cross-sectional view of a skate according to FIG. 5.
Figure 6A:
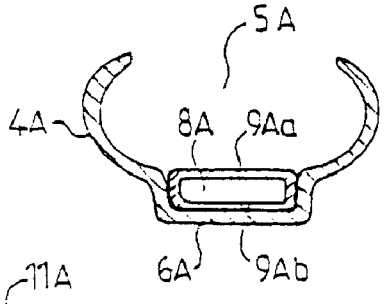
FIG. 6*a* is a transverse cross-sectional view of the skate according to FIG. 6.

Thus, according to FIGS. 5, 6, and 6*a*, the ventilation chamber 8A is provided within the internal sole of the boot defining a plantar support 9A with double wall 9Aa and 9Ab forming a recessed volume of predetermined thickness and attached within the shell 5A on the internal plane 6Aa of the external sole 6A.

Such a design not only makes it possible to render the plantar support removable, for washing, for example, but it can constitute, as a function of the selected material with which it is composed, an element for absorbing the weight of the skater.

Such a plantar support 9A can be made by blow molding a plastic material, independently of the remainder of the boot, and therefore removable as previously mentioned.

In this case, the inlet 11A for air A is made during the extrusion operation on the plantar support itself, and it communicates with the outside via an associated opening of the upper.

Figure 7:
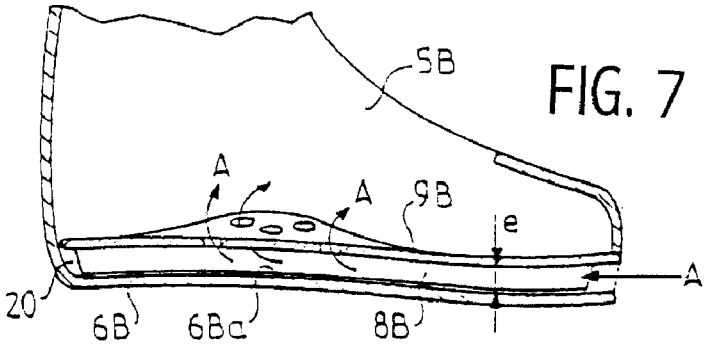
FIG. 7 is a longitudinal cross-sectional view of a skate according to an alternative embodiment of the ventilation arrangement.

The embodiment of FIG. 7 essentially differs from the previous ones in that the ventilation chamber 8B is demarcated between a plantar support 9B attached within the shell 5B and the internal plane 6Ba of the sole 6B with which it cooperates by providing a predetermined spacing "e" by means of longitudinal vertical ribs 20 extending from the plantar support 9B. The spacing "e" could also be obtained by a peripheral zone adjacent to the plantar support 9B (not shown in the drawing).

In this case, the spacing "e" between the plantar support 9B and the internal plane 6Ba of the sole 6B forming the ventilation chamber 8B is provided by the internal peripheral edge 20 of the plantar support.

Figure 8:
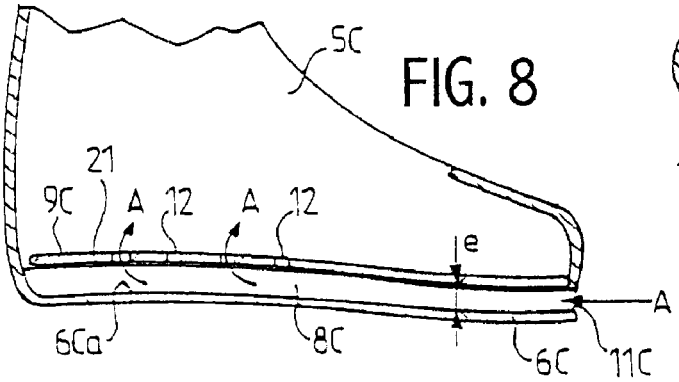
FIG. 8 is a longitudinal cross-sectional view of a skate according to an alternative embodiment of the ventilation arrangement.
Figure 8A:
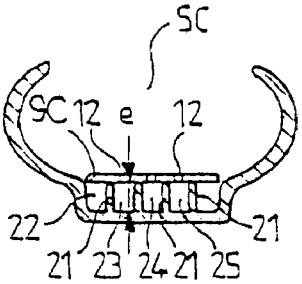
FIG. 8*a* is a transverse cross-sectional view of a skate according to FIG. 8.

In the example of FIGS. 8 and 8*a*, the difference resides in the fact that the spacing "e" between the plantar support 9*c* and the internal plane 6Ca of the sole 6C of the boot forming the ventilation chamber 8C is provided by vertical longitudinal ribs 21 extending from the internal plane 6Ca of the sole 6C, on top of which the plantar support 9C rests and whose lateral walls form nozzles 22, 23, 24, 25, . . . , for the passage of air A, across from which a plurality of aeration holes 12 are provided.

An inlet 11C for the air A is also provided at the front end of the shell above the sole 6C.

Figure 9:
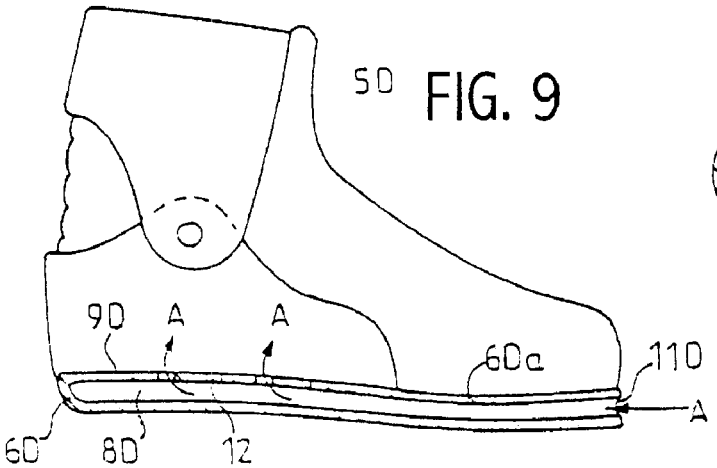
FIG. 9 is a longitudinal cross-sectional view of a skate according to an alternative embodiment of the ventilation arrangement.
Figure 9A:
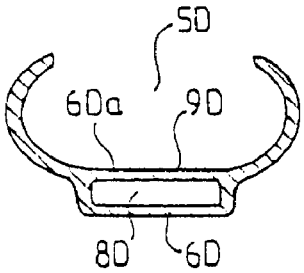
FIG. 9*a* is a transverse cross-sectional view of a skate according to FIG. 9.

Finally, according to the embodiment of FIGS. 9 and 9*a*, the ventilation chamber 8D is constituted by a recessed sole 6D defining a double bottom obtained during molding of the sole, and whose upper plane constitutes the plantar support 9D.

Likewise, an inlet 11D for the passage of air A is provided at the front, on the sole 6D.

Such an embodiment is particularly adapted to a construction of a flexible upper 5D assembled by gluing, in a known manner, to the sole 6D made independently by molding.

The plantar support demarcating the upper plane of the ventilation chambers can be designed in any other way, such as by assembling a plurality of elements, for example.

In summary of the various embodiments of the invention disclosed herein, the invention includes a ventilated sport shoe such as 4 or 4A, which preferably includes an upper shoe portion, such as 4/5, 4A/5A, 5B, 5C, or 5D, defining an interior adapted to receive a foot. The shoe includes a foot bed having a base, such as 6, 6A, 6B, 6C, or 6D, secured to the upper shoe portion, the foot bed defining an upper surface, such as 6*b*, capable of receiving the foot and the base defining a lower surface, such as 6*a*, capable of mounting the lower frame 2 thereon. The foot bed defines a ventilation channel, such as 8, 8B, 8C, or 8D, formed within or below the upper surface of the foot bed and at least partially traversing the foot bed from at least one inlet aperture, such as 11, 11A, 11B, 11C, or 11D, defined on an exterior of the lower surface of the base to an outlet aperture, such as 19, defined on the exterior of the lower surface of the base. The apertures provide ambient airflow into and out of the foot bed from the exterior of the base during use, the ventilation channel being in moisture transport communication, via holes 12, for example, with the interior of the upper shoe portion, thereby providing ventilation and moisture transfer from the received foot to the channel and out of the outlet aperture.

As disclosed, the upper shoe portion is configured for ventilation of upper portions of the foot.

The inlet aperture (such as 11, 11A, 11B, 11C, or 11D) is defined by the base (6, 6A, 6B, 6C, or 6D, e.g.) and is longitudinally spaced from the outlet aperture 19 relative to a longitudinal axis of the base. Further, the inlet aperture is defined adjacent a toe portion of the base and the outlet aperture is defined adjacent a heel portion of the base.

The inlet (11, 11A, 11B, 11C, 11D, e.g.) and outlet apertures (19, e.g.) and the ventilation channel (8, 8B, 8C, 8D, e.g.) are configured to provide continuous airflow therebetween for the length of the sport shoe, thereby providing ventilation and moisture transfer for substantially the entire length of the foot.

It is contemplated that at least one branch ventilation channel, or a plurality of such branch channels, can be provided to extend from a branch inlet aperture, defined on the exterior of the base between the toe portion and the heel portion, rearwardly to join the ventilation channel.

According to a particular embodiment of the invention, the lower surface of the base defines a projection projecting downwardly from the lower surface, the inlet ventilation aperture being defined within the projection. The inlet ventilation aperture is disposed on a forward face of the projection, such that the forward face is oriented towards a toe portion of the base. In this particular embodiment, the inlet ventilation aperture is positioned normal to the freestream airflow through the ventilation channel, thereby drawing airflow through the channel.

It is contemplated that the shoe of the invention can include a plurality of channels (14, 15; 22, 23, 24, 25, etc., e.g.) at least partially traversing the upper surface of the foot bed providing airflow into and out of the foot bed for corresponding portions of the foot bed during use. Thereby, the ventilation channels are arranged to ventilate at least a majority of the upper surface of the foot bed. Preferably, the plurality of channels are disposed substantially parallel to a longitudinal axis of the foot bed. Further, it is contemplated that the plurality of channels are arranged over or within substantially the entire width of the upper surface of the foot bed.

In a particular embodiment, the ventilation channel is to be configured for at least a portion of its length as a groove formed in the upper surface of the base. Note, e.g., the portion of the channels 14, 15 formed by lower surfaces 6*a* in FIG. 2., e.g., and, in FIG. 8*a*, note the ribs 21 extending upwardly from the sole 6C.

Further, according to a preferred embodiment, the ventilated sport shoe is adapted for use as an in-line skate shoe, with a lower frame secured to the base and a plurality of longitudinally aligned wheels mounted on the lower frame.

According to another particular embodiment, the ventilation channel 8C (see FIG. 8) is defined in the base 6C and the foot bed further comprises a substrate 9C received within the upper shoe portion between an upper surface of the base and a user's foot, the substrate defining a plurality of moisture transport pathways 12 in fluid communication with the ventilation channel 8C.

Further, the substrate 9C can comprise a last board received on the upper surface of the base and joining the upper shoe portion to the base. That is, the substrate, or plantar support, 9C is positioned on the top, i.e., on the upper surface, of the sole 6C (or base). Still further, the last board defines a plurality of apertures 12 vertically extending therethrough at least partially aligned and in fluid communication with the ventilation channel (8C; 22, 23, 24, 25, etc.). The substrate can further include an insole received within the interior of the upper shoe portion over the last board, with the insole defining a plurality of apertures vertically extending therethrough.

In further summary of the various embodiments disclosed herein, the invention includes a ventilated sport shoe such as 4 or 4A, which preferably includes an upper shoe portion, such as 4/5, 4A/5A, 5B, 5C, or 5D, defining an interior adapted to surround a user's foot. The shoe includes a foot bed having a base, such as 6, 6A, 6B, 6C, or 6D, secured to the upper shoe portion. The foot bed has an upper surface, such as 6*b*, that supports the user's foot, and the base has an exterior surface, wherein the base defines inlet ventilation apertures, such as 11, 11A, 11B, 11C, or 11D, and outlet ventilation apertures, such as 19, on the exterior surface of the base. Further, the foot bed defines a channel, such as 8, 8B, 8C, or 8D, extending from the inlet to the outlet apertures and at least partially along the upper surface of the foot bed to provide ambient airflow into and out of the foot bed from the exterior of the base during use. Further, moisture transport means, such as that provided by the inlet 11, air channel 8, apertures 12, etc., are provided for placing the channel in moisture transport communication with the interior of the upper shoe portion, such that motion of the skater during use causes airflow from the inlet aperture through the channel to the outlet aperture(s) to draw moisture from the interior of the skate. Lastly, a frame 2 is provided for mounting the plurality of wheels 3 secured to the exterior of the base.

In further summary of the various embodiments of the invention disclosed herein, the ventilated sport shoe includes an upper shoe portion (such as 4/5, 4A/5A, 5B, 5C, or 5D) which defines an interior adapted to receive a foot, as well as a foot bed including a base (such as 6, 6A, 6B, 6C, or 6D) secured to the upper shoe portion, the foot bed defining an upper surface (6*b*, e.g.) capable of receiving the foot and the base defining a lower surface (6*a*, e.g.) capable of mounting a lower frame (such as 2) thereon. Further, the foot bed defines a ventilation channel (such as 8, 8B, 8C, or 8D) formed within or below the upper surface of the foot bed and at least partially traversing the foot bed from an inlet aperture (such as 11, 11A, 11B, 11C, or 11D) defined on an exterior of the base to an outlet aperture (such as 19) defined on the exterior of the base, the apertures providing airflow into and out of the foot bed during use, wherein the ventilation channel is in moisture transport communication (via holes 12, e.g.) with the interior of the upper shoe portion, thereby providing a ventilation and moisture transfer from the received foot to the channel and out the outlet aperture, wherein the lower surface of the base defines a projection projecting downwardly from the lower surface, the inlet ventilation aperture being defined within the projection. Preferably, the inlet ventilation aperture is disposed on a forward face of the projection, such that the forward face is oriented towards a toe portion of the base. The inlet ventilation aperture is preferably positioned normal to the freestream airflow through the ventilation channel, thereby drawing airflow through the channel.

According to a summary of a particular preferred embodiment of the invention, the ventilated sport shoe of the invention includes a base having an upper shoe portion (such as 4/5, 4A/5A, 5B, 5C, 5D) adapted to receive a foot and a lower load-bearing surface (such as 2). The ventilated sport shoe includes a base (such as 6, 6A, 6B, 6C, or 6D) adapted to receive the upper shoe portion, the base defining an upper surface (such as 6*b*) capable of receiving the foot, and a lower surface (such as 6*a*) capable of mounting the load-bearing surface. The base defines a ventilation channel (such as 8, 8B, 8C, or 8D) at least partially traversing the upper surface of the base from an inlet aperture to an outlet aperture, the inlet and outlet apertures being defined on an exterior of the base to provide ambient airflow into and out of the base from the exterior of the base during use. Further, the shoe includes a substrate (such as 9C) received within the upper shoe portion on the upper surface of the base and includes a plurality of moisture transport pathways (12, e.g.) therethrough wherein air flow can flow from the aperture, through the ventilation channel, and out the outlet aperture (such as 19), drawing moisture from the foot through the moisture transport pathways.

What is claimed is:

1. A ventilated sport shoe including a lower frame portion mounting a bearing member, wherein the ventilated sport shoe comprises:

an upper shoe portion defining an interior adapted to receive a foot; and a foot bed including a base secured to the upper shoe portion, the foot bed defining an upper surface capable of receiving the foot and the base defining a lower surface capable of mounting the lower frame thereon, the foot bed defining a ventilation channel formed within or below the upper surface of the foot bed and at least partially traversing the foot bed from an inlet aperture defined on an exterior of the lower surface of the base to an outlet aperture defined on the exterior of the lower surface of the base, the apertures providing ambient airflow into and out of the foot bed from the exterior of the base during use, wherein the ventilation channel is in moisture transport communication with the interior of the upper shoe portion, thereby providing ventilation and moisture transfer from the received foot to the channel and out of the outlet aperture.

2. The ventilated sport shoe of claim 1, wherein the upper shoe portion is configured for ventilation of upper portions of the foot.

3. The ventilated sport shoe of claim 1, wherein the inlet aperture is defined by the base and is longitudinally spaced from the outlet aperture relative to a longitudinal axis of the base.

4. The ventilated sport shoe of claim 3, wherein the inlet aperture is defined adjacent a toe portion of the base and the outlet aperture is defined adjacent a heel portion of the base.

5. The ventilated sport shoe of claim 4, wherein the inlet and outlet apertures and the ventilation channel are configured to provide continuous airflow therebetween for the length of the sport shoe, thereby providing ventilation and moisture transfer for substantially the entire length of the foot.

6. The ventilated sport shoe of claim 4, further comprising at least one branch ventilation channel extending from a branch inlet aperture, defined on the exterior of the base between the toe portion and the heel portion, rearwardly to join the ventilation channel.

7. The ventilated sport shoe of claim 6, further comprising a plurality of branch ventilation channels.

8. The ventilated sport shoe of claim 1, wherein the lower surface of the base defines a projection projecting downwardly from the lower surface, the inlet ventilation aperture being defined within the projection.

9. The ventilated sport shoe of claim 8, wherein the inlet ventilation aperture is disposed on a forward face of the projection, such that the forward face is oriented towards a toe portion of the base.

10. The ventilated sport shoe of claim 9, wherein the inlet ventilation aperture is positioned normal to the freestream airflow through the ventilation channel, thereby drawing airflow through the channel.

11. The ventilated sport shoe of claim 1, wherein the ventilation channel comprises a plurality of channels at least partially traversing the upper surface of the foot bed providing airflow into and out of the foot bed for corresponding portions of the foot bed during use.

12. The ventilated sport shoe of claim 11, wherein the plurality of ventilation channels are arranged to ventilate at least a majority of the upper surface of the foot bed.

13. The ventilated sport shoe of claim 11, wherein the plurality of channels are disposed substantially parallel to a longitudinal axis of the foot bed.

14. The ventilated sport shoe of claim 11, wherein the plurality of channels are arranged over or within substantially the entire width of the upper surface of the foot bed.

15. The ventilated sport shoe of claim 1, wherein the ventilation channel is configured for at least a portion of its length as a groove formed in the upper surface of the base.

16. The ventilated sport shoe of claim 1, wherein the ventilated sport shoe is adapted for use as an in-line skate shoe, further comprising a lower frame secured to the base and a plurality of longitudinally aligned wheels mounted on the lower frame.

17. The ventilated sport shoe of claim 1, wherein the ventilation channel is defined in the base and the foot bed further comprises a substrate received within the upper shoe portion between an upper surface of the base and a user's foot, the substrate defining a plurality of moisture transport pathways in fluid communication with the ventilation channel.

18. The ventilated sport shoe of claim 17, wherein the substrate comprises a last board received on the upper surface of the base and joining the upper shoe portion to the base.

19. The ventilated sport shoe of claim 18, wherein the last board defines a plurality of apertures vertically extending therethrough at least partially aligned and in fluid communication with the ventilation channel.

20. An in-line skate including a plurality of wheels, comprising:

an upper shoe portion defining an interior adapted to surround a user's foot;

a foot bed including a base secured to the upper shoe portion, the foot bed having an upper surface that supports the user's foot and the base having an exterior surface, wherein the base defines inlet and outlet ventilation apertures on the exterior surface of the base, and the foot bed defines a channel extending from the inlet to the outlet aperture and at least partially along the upper surface of the foot bed to provide ambient airflow into and out of the foot bed from the exterior of the base during use;

moisture transport means for placing the channel in moisture transport communication with the interior of the upper shoe portion, such that motion of the skater during use causes airflow from the inlet aperture through the channel to the outlet aperture to draw moisture from the interior of the skate; and a frame for mounting the plurality of wheels secured to the exterior of the base.

21. A ventilated sport shoe base having an upper shoe portion adapted to receive a foot and a lower load-bearing surface, wherein the ventilated sport shoe comprises:

a base adapted to receive the upper shoe portion, the base defining an upper surface capable of receiving the foot and a lower surface capable of mounting the load-bearing surface, the base defining a ventilation channel at least partially traversing the upper surface of the base from an inlet aperture to an outlet aperture, the inlet and outlet apertures being defined on an exterior of the base to provide ambient airflow into and out of the base from the exterior of the base during use; and a substrate received within the upper shoe portion on the upper surface of the base and including a plurality of moisture transport pathways therethrough wherein air can flow from the aperture, through the ventilation channel, and out the outlet aperture, drawing moisture from the foot through the moisture transport pathways.

22. A ventilated sport shoe including a lower frame portion mounting a bearing member, wherein the ventilated sport shoe comprises:

an upper shoe portion defining an interior adapted to receive a foot; and a foot bed including a base secured to the upper shoe portion, the foot bed defining an upper surface capable of receiving the foot and the base defining a lower surface capable of mounting the lower frame thereon, the foot bed defining a ventilation channel formed within or below the upper surface of the foot bed and at least partially traversing the foot bed from an inlet aperture defined on an exterior of the base to an outlet aperture defined on the exterior of the base, the apertures providing airflow into and out of the foot bed during use, wherein the ventilation channel is in moisture transport communication with the interior of the upper shoe portion, thereby providing a ventilation and moisture transfer from the received foot to the channel and out the outlet aperture, wherein the lower surface of the base defines a projection projecting downwardly from the lower surface, the inlet ventilation aperture being defined within the projection.

23. The ventilated sport shoe of claim 22, wherein the inlet ventilation aperture is disposed on a forward face of the projection, such that the forward face is oriented towards a toe portion of the base.

24. The ventilated sport shoe of claim 23, wherein the inlet ventilation aperture is positioned normal to the freestream airflow through the ventilation channel, thereby drawing airflow through the channel.

* * * * *